US009745832B2

(12) United States Patent
Nicol et al.

(10) Patent No.: US 9,745,832 B2
(45) Date of Patent: Aug. 29, 2017

(54) TOOL FOR CREATING IMPRESSIONS OF DOWNHOLE OBJECTS

(71) Applicant: Good Son Technologies LLC, Dickinson, ND (US)

(72) Inventors: William Daniel Nicol, Red Lodge, MT (US); Chad Allison Nicol, Dickinson, ND (US)

( * ) Notice: Subject to any disclaimer, the term of this patent is extended or adjusted under 35 U.S.C. 154(b) by 277 days.

(21) Appl. No.: 14/825,967

(22) Filed: Aug. 13, 2015

(65) Prior Publication Data

US 2017/0044874 A1 Feb. 16, 2017

(51) Int. Cl.

| | |
|---|---|
| ***E21B 41/00*** | (2006.01) |
| ***E21B 31/00*** | (2006.01) |
| ***E21B 47/09*** | (2012.01) |
| ***E21B 31/12*** | (2006.01) |
| ***E21B 47/08*** | (2012.01) |
| ***E21B 31/18*** | (2006.01) |

(52) U.S. Cl.

CPC ..... *E21B 41/00* (2013.01); *E21B 31/00* (2013.01); *E21B 31/12* (2013.01); *E21B 31/18* (2013.01); *E21B 47/08* (2013.01); *E21B 47/0915* (2013.01)

(58) Field of Classification Search

CPC ..... E21B 31/12; E21B 31/18; E21B 47/0915; E21B 47/08

See application file for complete search history.

(56) References Cited

U.S. PATENT DOCUMENTS

| | | | | |
|---|---|---|---|---|
| 2,621,415 | A * | 12/1952 | Cooper | B21D 11/203 33/561.1 |
| 2,824,378 | A * | 2/1958 | Stokes | E21B 47/0915 33/561.1 |
| 3,115,196 | A * | 12/1963 | Roxström | E21B 25/16 175/44 |
| 7,654,021 | B2 * | 2/2010 | Kleyman | G01B 5/207 33/561.1 |
| 8,294,758 | B2 * | 10/2012 | Lynde | E21B 31/00 33/552 |
| 8,307,895 | B2 | 11/2012 | Lund | |
| 8,403,056 | B2 | 3/2013 | Gette et al. | |
| 8,727,755 | B2 | 5/2014 | Guidry et al. | |
| 2010/0212890 | A1 | 8/2010 | Lund | |
| 2012/0024541 | A1 | 2/2012 | Gette et al. | |

(Continued)

FOREIGN PATENT DOCUMENTS

WO 2014077697 A1 * 5/2014 ..... E21B 47/09

*Primary Examiner* — Cathleen Hutchins
*Assistant Examiner* — Jonathan Malikasim
(74) *Attorney, Agent, or Firm* — Antoinette M. Tease

(57) ABSTRACT

A tool for creating impressions of downhole objects comprising a cylindrical outer casing, a top plate, a plunger, an end plate, a lever, a pressure lock plate, a pressure base, a main spring platform, a main spring, and a plurality of elongated rods. The elongated rods extend from beneath the main spring platform through the pressure lock plate, the pressure base, and the end plate. Each elongated rod is surrounded by a rod spring and a collar. The rod spring extends from the bottom of the pressure base to the collar. The pressure lock plate moves laterally when the lever pivots from a locked to an unlocked position, thereby aligning the plurality of holes in the pressure lock plate with the plurality of holes in the pressure base and enabling the elongated rods to move longitudinally within the tool.

10 Claims, 16 Drawing Sheets

(56) References Cited

U.S. PATENT DOCUMENTS

| | | | | |
|---|---|---|---|---|
| 2013/0207301 | A1 | 8/2013 | Guidry et al. | |
| 2014/0138969 | A1 | 5/2014 | Guidry et al. | |
| 2014/0217639 | A1 | 8/2014 | Guidry et al. | |
| 2016/0084064 | A1* | 3/2016 | Clemens | E21B 47/0915 166/301 |

* cited by examiner

TOOL FOR CREATING IMPRESSIONS OF DOWNHOLE OBJECTS

BACKGROUND OF THE INVENTION

1. Field of the Invention

The present invention relates generally to the field of tools used in the oil and gas industry, and more particularly, to a tool that is designed to create an impression of an object in an oil well hole.

2. Description of the Related Art

In the oilfield, occasionally tools, wirelines and pipes will break off when down in the well hole. When this happens, a "fishing" company is called in to retrieve the broken object. In order to retrieve the object, the operator needs to know the shape of the object so that he can ascertain the best way to secure and remove it. Currently, the standard tool used to determine the shape of an object located downhole is called an "impression block." An impression block is essentially an attachment that holds a slab of soft lead. The impression block is sent down the well hole, rammed into the stuck object, and then pulled out of the well hole for inspection. The operator then inspects the impressions left in the slab of lead to glean what information he can about the shape of the object with which it came into contact.

This method has a number of disadvantages. The markings in the lead slab are typically only about half an inch deep, which provides limited information about the overall shape of the object in the well hole. Inaccurate or incomplete information about the shape of the object can cause the operator to use the wrong grabbing tool, which in turn leads to longer retrieval times and higher costs. With the present invention, the inventors have created a tool that captures a significantly greater degree of information about the shape of the downhole object, thereby eliminating extra time and cost from the process. The automatic brake system of the present invention is key to its functionality in that it locks the elongated rods into place once the image has been taken. Other inventions for determining the shape and/or ascertaining the position of objects in oil wells are described below.

U.S. Pat. No. 2,824,378 (Stokes, 1953) discloses an apparatus for determining the contour and position of obstructions in wells. The device comprises a tubular body with an open lower end and a plurality of elongated elements mounted within the body for longitudinal movement relative thereto. The lower ends of the elongated elements are positioned for engagement with an object in the well bore so that the elements move longitudinally in accordance with the contour and position of the object. When the lower ends of the elongated elements encounter an object in the well hole, the elements move longitudinally upward within the body of the device. Longitudinal movement of the elongated elements is restricted by friction material situated within the body of the device. To reset the device, a plunger pushes down on the upper ends of the elongated elements.

U.S. Pat. No. 8,307,895 (Lund, 2012) provides a method and apparatus for imaging objects in a wellbore using a plurality of actuatable members that are axially displaced to form an image of the object. An actuable member displacement sensor detects the displacement of the actuatable members. The actuatable members are coupled to some form of drive mechanism (spring, gravity, magnetic, hydraulic, etc.) that extends and/or retracts the actuatable members. The axial displacement sensor is positioned on any portion of the imaging apparatus.

U.S. Pat. No. 8,403,056 (Gene et al., 2013) discloses a system and method for verifying support hanger orientation within a wellhead housing. This invention utilizes the conventional "impression block" described above in the Background section. The invention is a running tool with an annular mandrel and a connector at the upper end of the mandrel to connect it to a drill pipe. The running tool includes a cylindrical body with a lead block assembly mounted within it. The purpose of the lead block assembly is to generate an impression of the casing hanger within the wellhead housing.

U.S. Pat. No. 8,727,755 (Guidry et al., 2014) provides a system and method for obtaining an impression of an object in a remote environment (as in a well hole). An impression block is affixed to a running string and used to form an impression of an object. The impression block comprises a retaining section and an impression section. The impression section is formed of a shape memory material that changes shape at or above a predetermined transition temperature and a metallic shape memory alloy that changes shape below a predetermined transition temperature.

U.S. Patent Application Pub. No. 2014/0138969 (Guidry et al.) describes a fishing guide for directing a skewed fish in a wellbore. The guide has an open end and a finger structure comprised of a shape memory alloy. The fingers are retracted as the tool passes through a restriction. Once past the restriction, heaters on the fingers cause the alloy to heat up to its transition temperature, thereby causing the lower end of the guide to fan out and surround a skewed fish that is in a slanted position and leaning on a wall of a surrounding tubular that has a larger dimension than the restriction. The assembly is advanced until the fish is captured by the tool and pulled out of the hole, and the fingers are forcibly retracted as the assembly is pulled back through the restriction.

BRIEF SUMMARY OF THE INVENTION

The present invention is a tool for creating impressions of downhole objects comprising: a cylindrical outer casing; a top plate that is situated inside of the outer casing at a top end of the tool; a plunger that is situated directly underneath the top plate; an end plate that is situated inside of the outer casing at a bottom end of the tool; a lever with a top end and a bottom end, the lever being situated within a longitudinal slot in the outer casing; a pressure lock plate; a pressure base that is situated beneath the pressure lock plate; a main spring platform that is situated beneath the plunger, the pressure lock plate being situated beneath and spaced apart from the main spring platform; a main spring that is situated between the plunger and the main spring platform; and a plurality of elongated rods that are not attached to the main spring platform but extend from beneath the main spring platform through a plurality of holes in the pressure lock plate, through a plurality of holes in the pressure base, and through a plurality of holes in the end plate, wherein each of the plurality of elongated rods is surrounded by a rod spring and a collar that is situated below the rod spring, and wherein the rod spring on each of the plurality of elongated rods extends from a bottom of the pressure base to the collar; wherein the pressure lock plate moves laterally when the lever pivots from a locked to an unlocked position, thereby aligning the plurality of holes in the pressure lock plate with the plurality of holes in the pressure base and enabling the elongated rods to move longitudinally within the tool.

In a preferred embodiment, the outer casing comprises a first lateral slot through which at least a portion of the pressure lock plate extends and a second lateral slot through which at least a portion of the main spring platform extends.

Preferably, the portion of the pressure lock plate that extends through the first lateral slot and the portion of the main spring platform that extends through the second lateral slot are flush with an outer surface of the outer casing.

In a preferred embodiment, the plunger comprises a recess with a floor, the recess being situated between a top section of the plunger and a midsection of the plunger, wherein the top section and the midsection each has an outer diameter, wherein the outer diameter of the top section is approximately equal to the outer diameter of the midsection, wherein the plunger further comprises a bottom section with an outer diameter that is less than the outer diameters of the top section and midsection, and wherein the bottom section extends through a center of the main spring. Preferably, the lever comprises a top end and a bottom end, wherein the top end of the lever is situated against an outer wall of the plunger when the tool is in a locked position, wherein when the plunger is pushed downward, the top end of the lever moves into the recess in the outer wall of the plunger, and the lever pivots on a shaft that resides in a recess set into the outer casing, and wherein when the plunger is moved upward, the top end of the lever slides along the floor of the recess until it is situated against the outer wall of the plunger.

In a preferred embodiment, the floor of the recess is preferably slanted diagonally downward. Preferably, when the top end of the lever moves into the recess in the plunger, the lever pivots so that the bottom end of the lever moves laterally outward, thereby causing the plurality of holes in the pressure lock plate to realign with the plurality of holes in the pressure base. Preferably, when the plunger is moved upward and the top end of the lever slides along the floor of the recess until it is situated against the outer wall of the plunger, the lever pivots so that the bottom end of the lever moves laterally inward, thereby moving the pressure lock plate laterally so that the plurality of holes in the pressure lock plate do not align with the plurality of holes in the pressure base and the elongated rods are squeezed.

In a preferred embodiment, the bottom end of the lever terminates at a point directly adjacent to an outside surface of the pressure lock plate above a top surface of the pressure base. Preferably, the pressure lock plate has a thickness, and the bottom end of the lever is approximately as long as the thickness of the pressure lock plate.

REFERENCE NUMBERS

Figure 1:
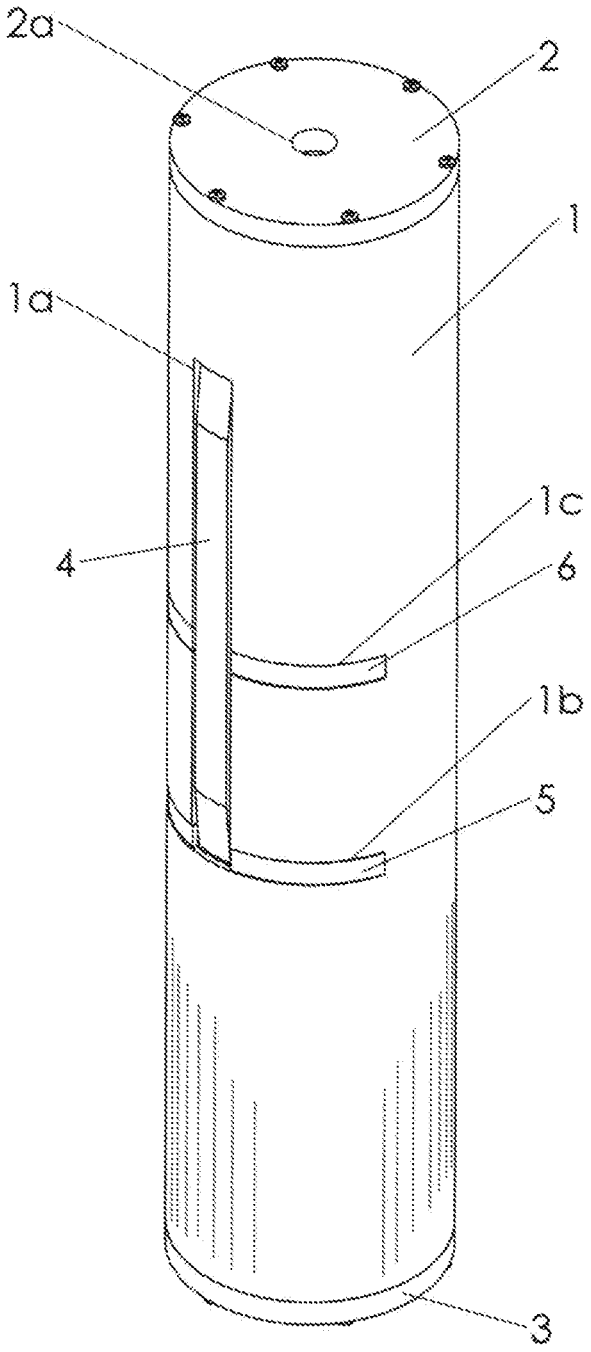
FIG. 1 is a first perspective view of the present invention in a pre-imaging (locked) state.

1 Outer casing
1*a* Longitudinal slot (in outer casing)
1*b* First lateral slot (in outer casing)
1*c* Second lateral slot (in outer casing)
2 Top plate
2*a* Aperture (in top plate)
3 End plate
4 Lever
4*a* Shaft (of lever)
4*b* Top end (of lever)
4*c* Bottom end (of lever)
5 Pressure lock plate
5*a* Protruding portion (of pressure lock plate)
6 Main spring platform
6*a* Protruding portion (of main spring platform)
7 Elongated rods
8 Plunger
8*a* Recess (in outer wall of plunger)
8*b* Floor (of recess 8*a*)
8*c* Top section (of plunger)
8*d* Midsection (of plunger)
8*e* Bottom section (of plunger)
9 Main spring
10 Pressure base
11 Rod spring
12 Collar (on rod)
13 Wireline-to-tool adapter

DETAILED DESCRIPTION OF INVENTION

The present invention is a cylindrical tool with an outside diameter that is slightly smaller than the inside diameter of an oil well. On the top end of the tool is a wireline-to-tool adapter (a standard connection type for oil well tools). On the other end of the tool is a grid of metal spring-loaded elongated rods that are locked into place when the tool is sent downhole. When the elongated rods are unlocked (the mechanism for which is explained below), each rod extends out of the bottom end of the tool for a certain distance; in a preferred embodiment, this distance is six inches. The default position of the tool is a locked state. The tool switches to an unlocked state when about one hundred (100) pounds of pressure is applied downward to the connector on the top end of the tool. When this pressure is removed, the locking mechanism automatically returns to its default state (locked). The structure of the present invention, including the locking mechanism, is explained more fully below.

FIG. 1 is a first perspective view of the present invention in a pre-imaging (locked) state. As shown in this figure, the present invention comprises an outer casing 1, a top plate 2, an end plate 3 and a lever 4. The top plate 2 is preferably screwed or bolted to a top end of the outer casing 1, and the end plate 3 is preferably screwed or bolted to a bottom end of the outer casing 1. When not rotated (i.e., when in a locked state), the lever 4 is parallel to the tool's longitudinal axis and is recessed into a longitudinal slot 1*a* in the outer casing 1. The tool further comprises a pressure lock plate 5 and a main string platform 6. In a preferred embodiment, the outer casing 1 comprises a first lateral slot 1*b* through which at least a portion of the pressure lock plate 5 extends and a second lateral slot 1*c* through which at least a portion of the main spring platform 6 extends. These lateral slots 1*b*, 1*c* prevent both the pressure lock plate 5 and the main spring platform 6 from moving longitudinally within the outer casing 1. Note that the top plate 2 preferably comprises an aperture 2*a* through which the wireline-to-tool adapter (not shown) is attached to the plunger (see FIG. 1).

Figure 2:
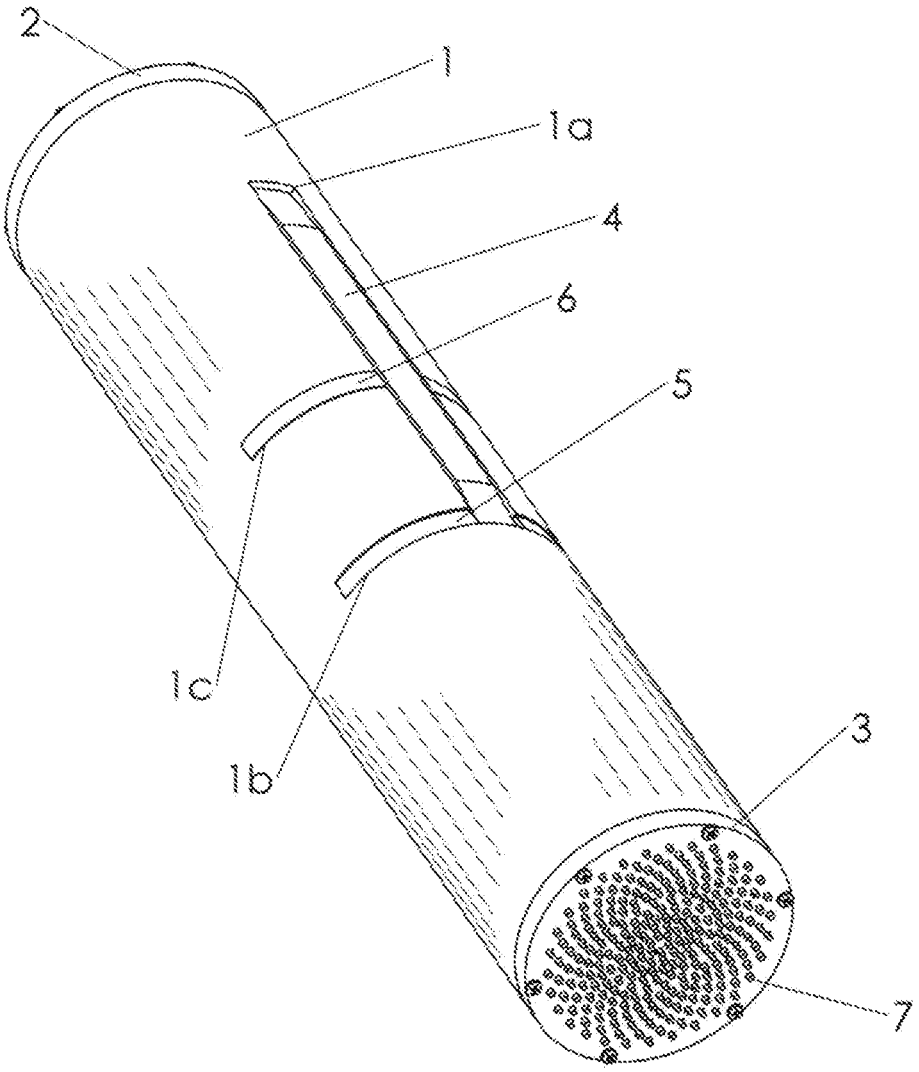
FIG. 2 is second perspective view of the present invention in a pre-imaging (locked) state.

FIG. 2 is second perspective view of the present invention in a pre-imaging (locked) state. As shown in this figure, a plurality of elongated rods 7 extends through a plurality of apertures in the end plate 3. The present invention is not limited to a particular number or configuration of the elongated rods 7, but the elongated rods 7 must be sufficiently numerous and spaced closely enough to one another to generate a meaningful image of the obstruction in the well hole. The elongated rods 7 are preferably comprised of stainless steel.

Figure 3:
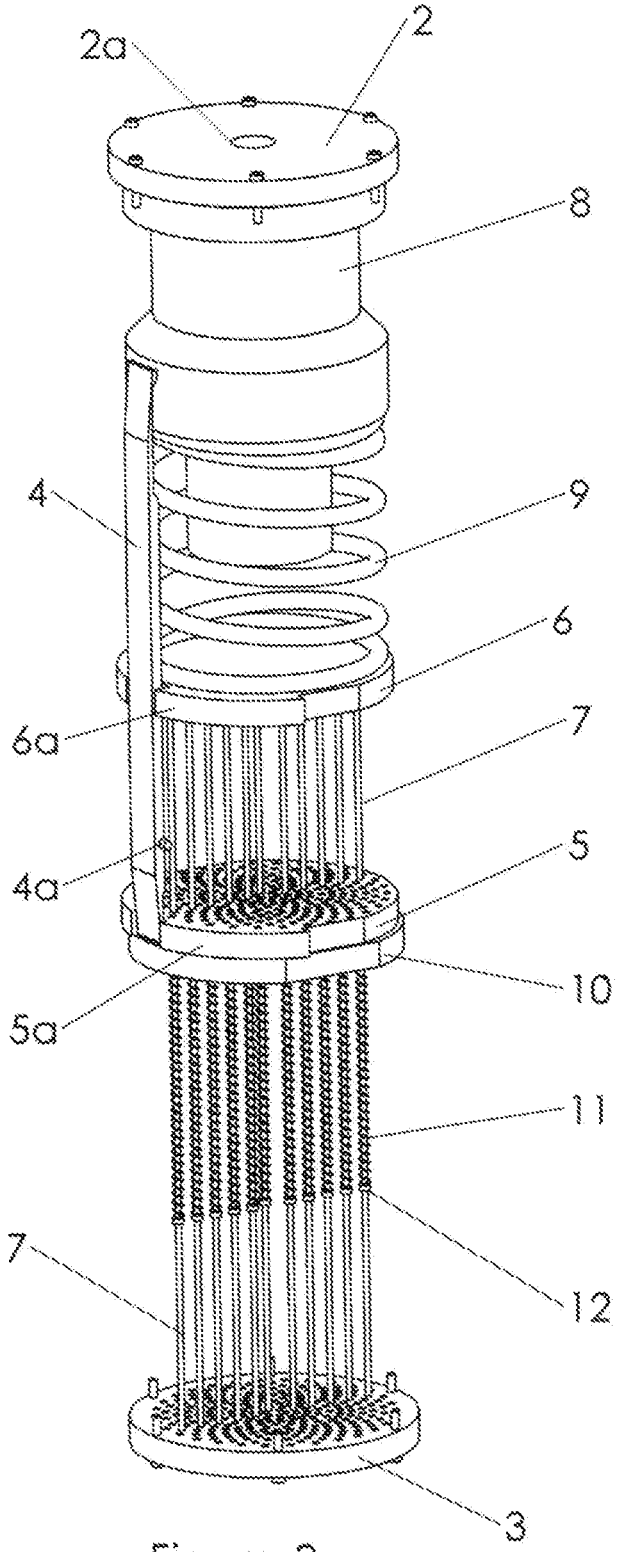
FIG. 3 is a perspective view of the present invention in a pre-imaging (locked) state shown with the outer casing and a number of the elongated rods removed for clarity.

FIG. 3 is a perspective view of the present invention in a pre-imaging (locked) state shown with the outer casing and a number of the elongated rods removed for clarity. As shown in this figure, situated directly underneath the top plate 2 is a plunger 8. A main spring 9 is situated between the plunger and the main spring platform 6. The lever 4 pivots on a shaft 4*a* that resides in a recess set into the outer casing (not shown in this figure). The elongated rods 7 are not attached to the main spring platform 6 but extend from beneath the main spring platform 6 through the pressure lock plate 5 and then through the pressure base 10, which is situated directly beneath the pressure lock plate 5. The elongated rods 7 continue to extend from the pressure lock plate 5 to (and through) the end plate 3. Surrounding each elongated rod 7 are a rod spring 11 and collar 12. The rod springs 11 extend from the bottom of the pressure base 10 to the collar 12. The collars 12 are preferably situated on the elongated rods 7 so as to prevent them from extending beyond the end plate 3 by a certain distance (as noted above, in a preferred embodiment, this distance is roughly six inches); therefore, the outer diameter of each collar 12 is greater than the inner diameter of the holes in the end plate 3. The outer diameter of the elongated rods 7, on the other hand, is slightly smaller than the inner diameter of the holes in the end plate 3.

Note that the number and configuration of holes in the pressure base 10 and pressure lock plate 5 necessarily corresponds to the number and configuration of holes in the end plate 3. There are no holes in the main spring platform 6. Although the pressure base 10 and pressure lock plate 5 are shown in FIG. 3 as being adjacent to (that is, flat against) each other, there may also be a small gap between these two components (so that they are not in contact with each other). The pressure base 10 is held in place by virtue of the pressure of the upper end of the rod springs 11 (which are in a compressed state as shown in FIG. 3) against the pressure base 10 the lower end of the rod springs 11 are restricted by the collars 12). As shown in FIG. 3, the pressure lock plate 5 and main spring platform 6 each has a protruding portion 5*a*, 6*a* that extends through the lateral slots 1*b*, 1*c* in the outer casing 1. The outer surfaces of the protruding portions 5*a*, 6*a* are preferably flush with the outer surface of the outer casing 1.

Figure 4:
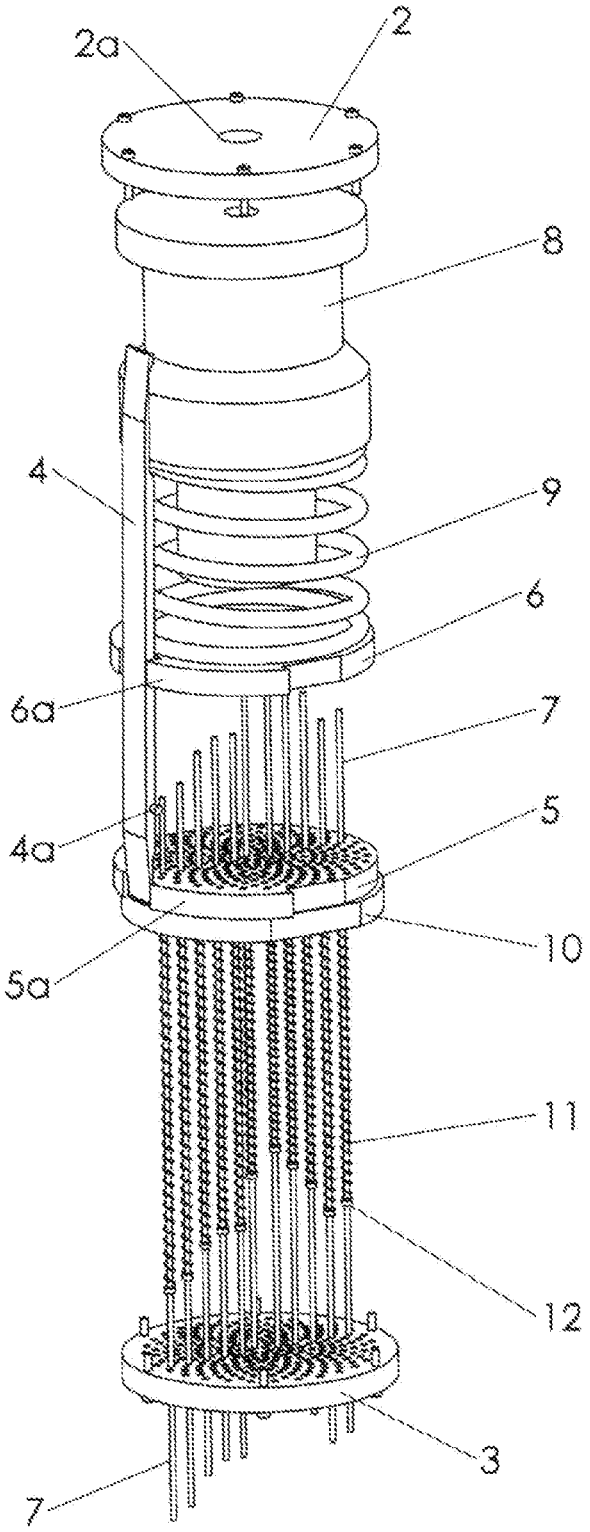
FIG. 4 is a perspective view of the present invention in an unlocked state shown with the outer casing and a number of the elongated rods removed for clarity.

FIG. 4 is a perspective view of the present invention in an unlocked state shown with the outer casing and a number of the elongated rods removed for clarity. When the tool is in a locked state, the elongated rods 7 are prevented from moving longitudinally (i.e., up and down) within the tool. This is accomplished by virtue of a slight misalignment of the pressure lock plate 5 and pressure base 10 (see FIGS. 15 and 16); this misalignment squeezes the elongated rods 7 in the apertures in the pressure lock plate 5 and pressure base 10 so that they are unable to move. In operation, the tool attached to a wire line and sent down the well hole in a pre-imaging, locked state (as shown in FIG. 3). When the tool encounters an obstruction in the well hole, the tool will not be able to move any further downhole. The wire line operator will then apply greater than 100 pounds of pressure to the tool with the wire line. When this occurs, the plunger 8 is pushed downward (and the main spring 9 is compressed), thereby causing the upper end of the lever 4 to move from a locked to an unlocked position and the tool to move from a locked to an unlocked state (this is described more fully below in connection with FIGS. 9-14). When the lever 4 moves from a locked to an unlocked position, the pressure lock plate 5 moves slightly literally so that the holes in the pressure lock plate 5 and in the pressure base 10 are now aligned, thereby allowing the elongated rods 7 to move freely (longitudinally only) within the tool.

Once the elongated rods 7 are allowed to move longitudinally, the rod springs 11 push the elongated rods 7 downward toward the obstruction (not shown in FIG. 4 but see Figure). As noted above, the downward movement of the elongated rods 7 is limited by the collars 12 so as to prevent the elongated rods 7 from being ejected from the tool altogether. The downward movement of each elongated rod 7 preferably stops short of the collar 12 by virtue of its contact with the obstruction in the well hole.

Figure 5:
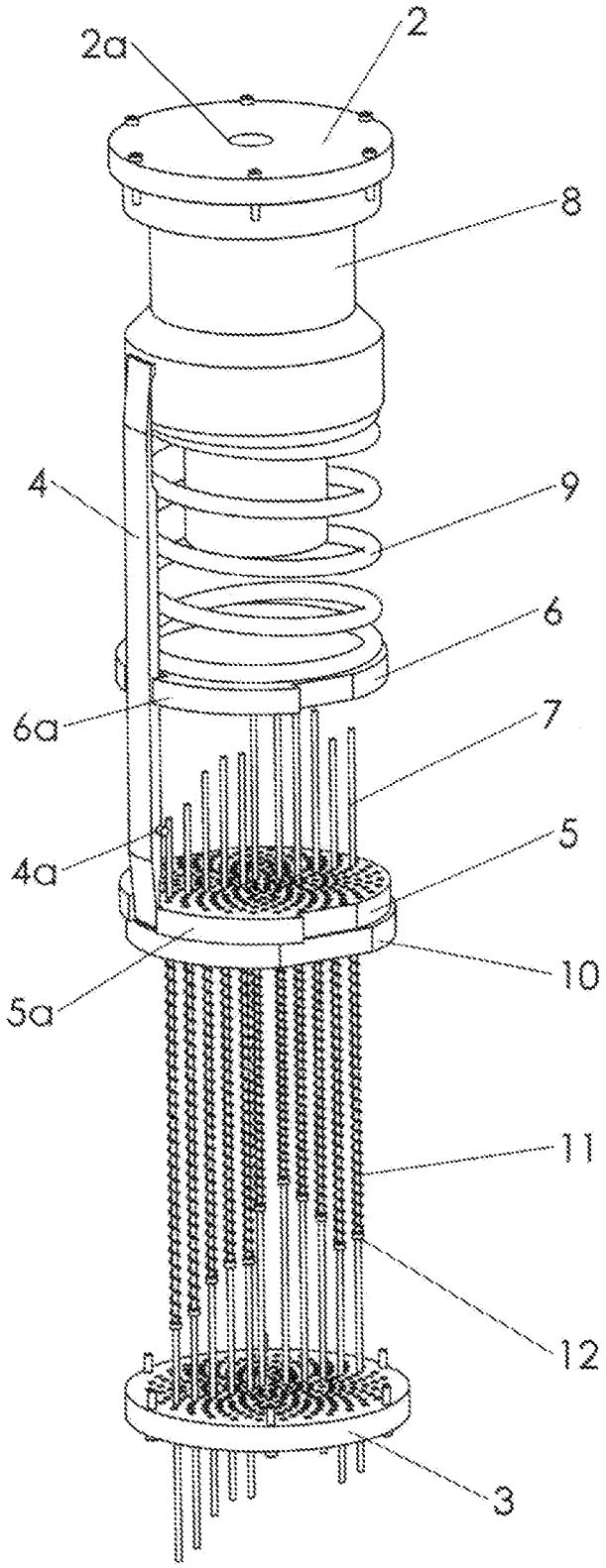
FIG. 5 is a perspective view of the present invention in a post-imaging (locked) state shown with the outer casing and a number of the elongated rods removed for clarity.

FIG. 5 is a perspective view of the present invention in a post-imaging (locked) state shown with the outer casing and a number of the elongated rods removed for clarity. After the tool hits the obstruction and the tool is unlocked by the operator, then the operator pulls upward on the wire line, which causes the plunger 8 to move upward and the pressure lock plate 5 and pressure base 10 to move into a locked position (via the lever 4, as explained more fully below), thereby preventing the elongated rods 7 from moving longitudinally and locking them into place. The tool is then retrieved from the well hole, and the operator visually inspects the pattern created by the bottom ends of the elongated rods 7 to determine the nature of the obstruction.

Figure 6:
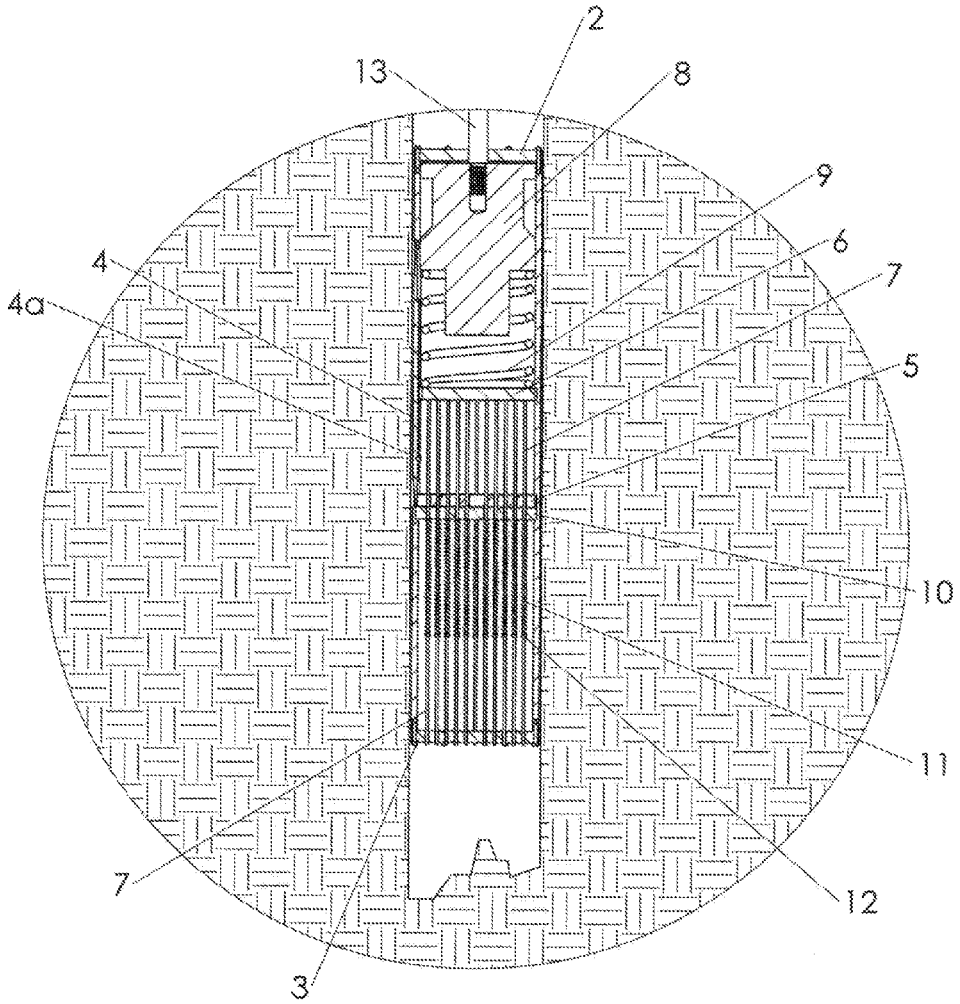
FIG. 6 is a section view of the present invention in a pre-imaging (locked) state shown in situ in a well hole before encountering an obstruction.

FIG. 6 is a section view of the present invention in a pre-imaging (locked) state shown in situ in a well hole before encountering an obstruction. In this figure, the tool is in the same state as that shown in FIG. 3. Note that the wireline-to-tool adapter 13 extends through a central aperture in the top plate 2 and screws into the top end of the plunger 8.

Figure 7:
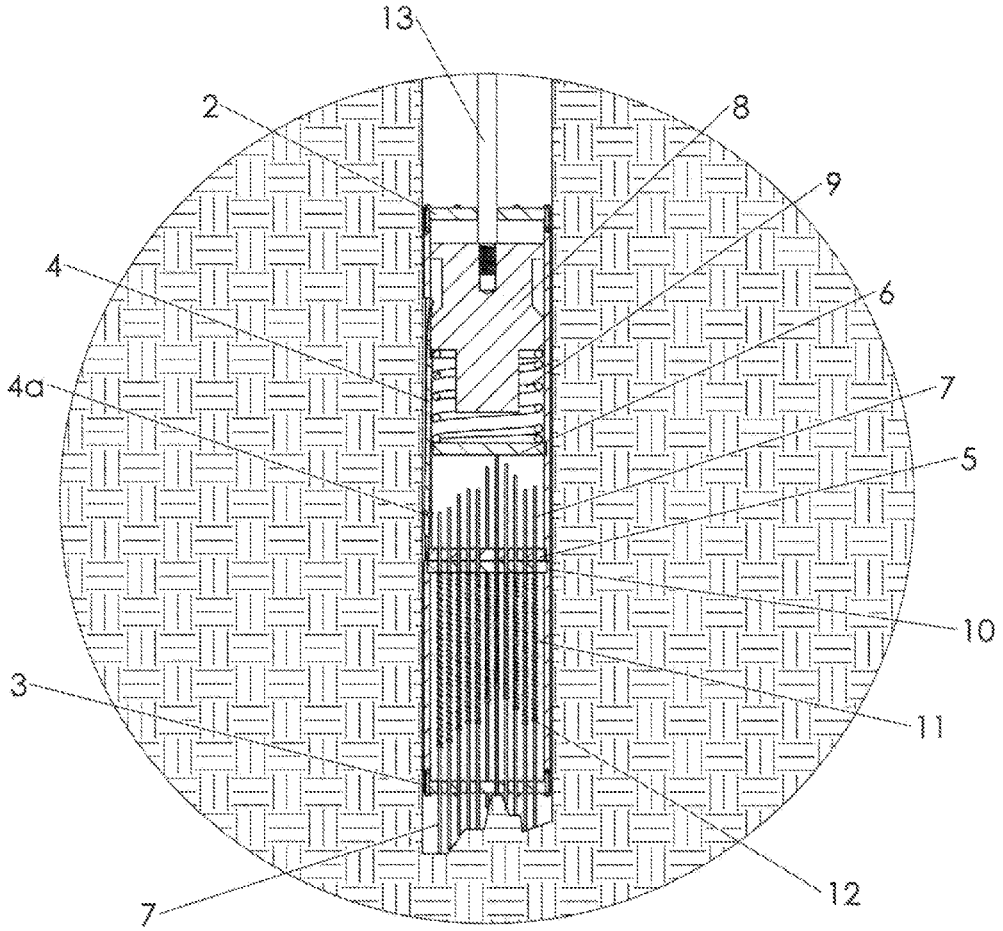
FIG. 7 is a section view of the present invention in an unlocked state shown in situ in a well hole upon encountering an obstruction.

FIG. 7 is a section view of the present invention in an unlocked state shown in situ in a well hole upon encountering an obstruction. In this figure, the tool is in the same state as that shown in FIG. 4.

Figure 8:
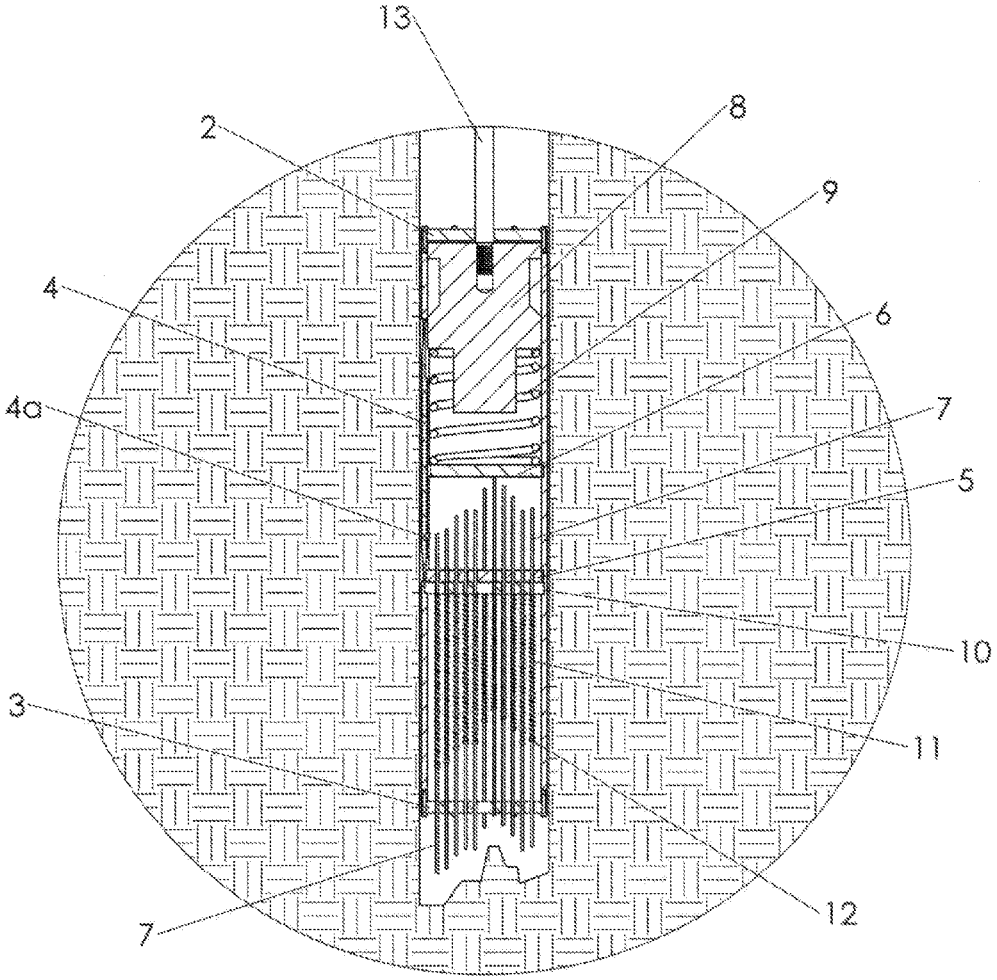
FIG. 8 is a section view of the present invention in a post-imaging (locked) state shown in situ in a well hole after encountering an obstruction.

FIG. 8 is a section view of the present invention in a post-imaging (locked) state shown in situ in a well hole after encountering an obstruction. In this position, the tool is in the same state as that shown in FIG. 5.

Figure 9:
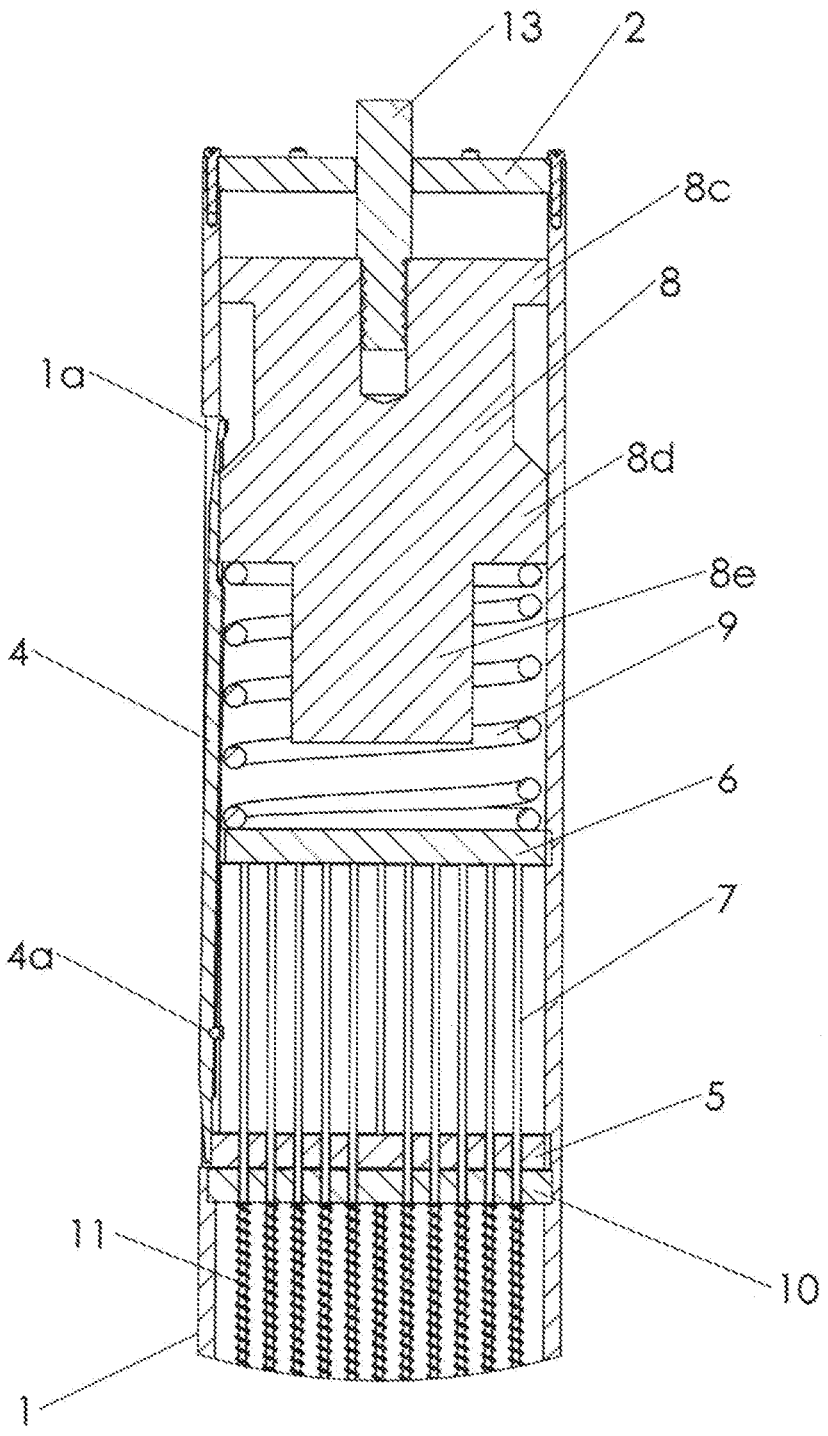
FIG. 9 is a detail section view of the present invention in an unlocked state.
Figure 10:
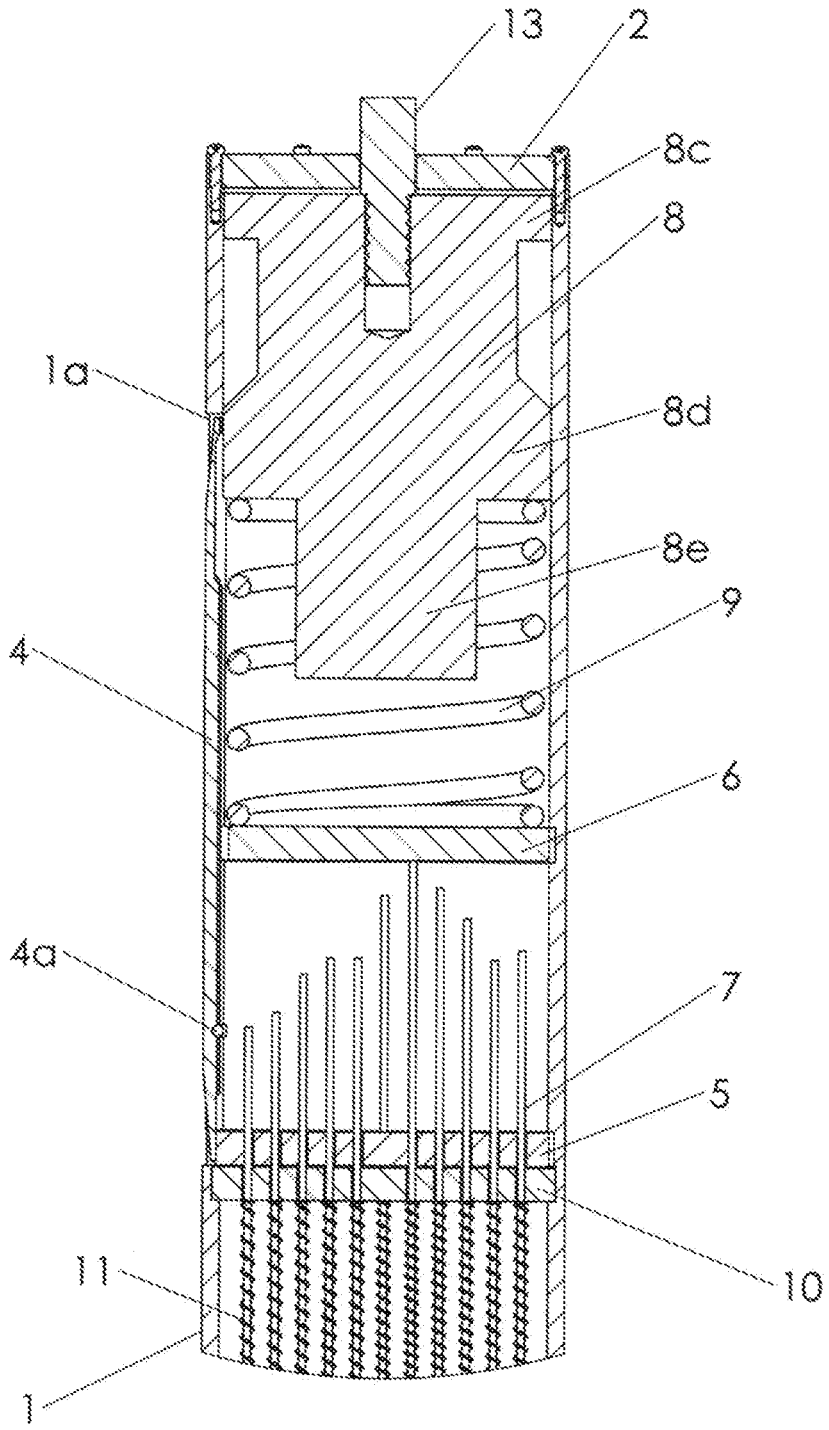
FIG. 10 is a detail section view of the present invention in a post-imaging (locked) state.

FIG. 9 is a detail section view of the present invention in an unlocked state. FIG. 10 is a detail section view of the present invention in a post-imaging (locked) state. These two figures clearly show the shape of the plunger 8, which has a recess 8*a* with a floor 8*b* (see FIGS. 11 and 12). The recess 8*a* is situated between the top section 8*c* and the midsection 8*d*, both of which have the same outer diameter. A bottom section 8*e*, which has an outer diameter that is smaller than the outer diameter of the top section 9*c* and midsection 3*d*, extends through the center of the main spring 9.

Figure 16:
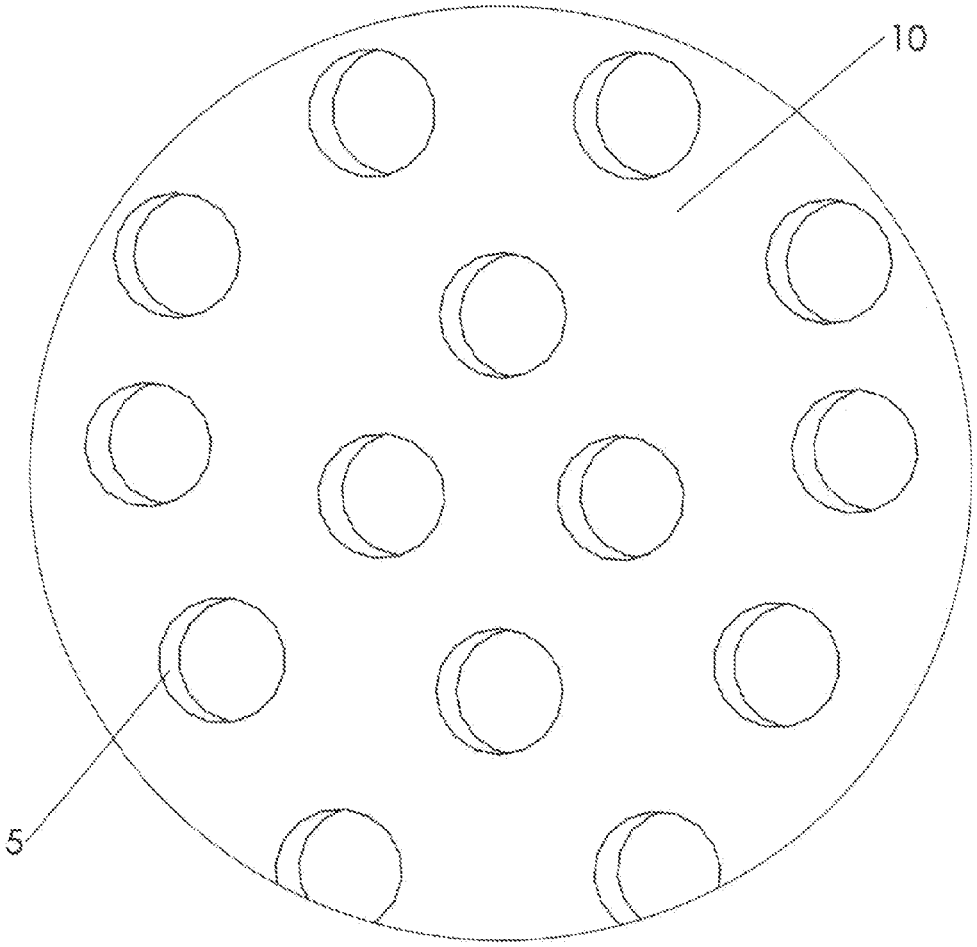
FIG. 16 is a bottom view of the pressure base and pressure lock plate showing the alignment of these two components when the present invention is in a locked state.

As a result of the downward movement of the plunger 8 in FIG. 9, the top end of the lever 4 has pivoted inward, and the bottom end of the lever 4 has pivoted outward. When the bottom end of the lever 4 pivots outward, the pressure lock plate 5 moves slightly laterally in the direction of the bottom end of the lever 4 (as a result of the removal of the pressure of the bottom end of the lever 4 against the pressure lock plate 5), thereby causing the holes in the pressure lock plate 5 and the holes in the pressure base 10 to align, as shown in FIG. 16. When the holes in the pressure lock plate 5 and the holes in the pressure base 10 are aligned, the elongated rods 7 are able to move longitudinally within the tool, as described previously. With the tool in an unlocked state, the rod springs 11 push the elongated rods 7 downward (out the bottom end of the end plate 3) until they come into contact with the obstruction. To lock the tool again after the elongated rods 7 have come into contact with the obstruction, the operator removes the pressure exerted by the wire line against the tool, and the main spring 9 pushes the plunger 8 in an upward direction within the tool. The upward movement of the plunger 8 within the tool forces the lever 4 back into a locked position (see FIGS. 12, 14 and 16), which in turn causes a slight misalignment of the holes in the pressure lock plate 5 and the pressure hose 10, thereby locking the elongated rods 7 in place.

Figure 11:
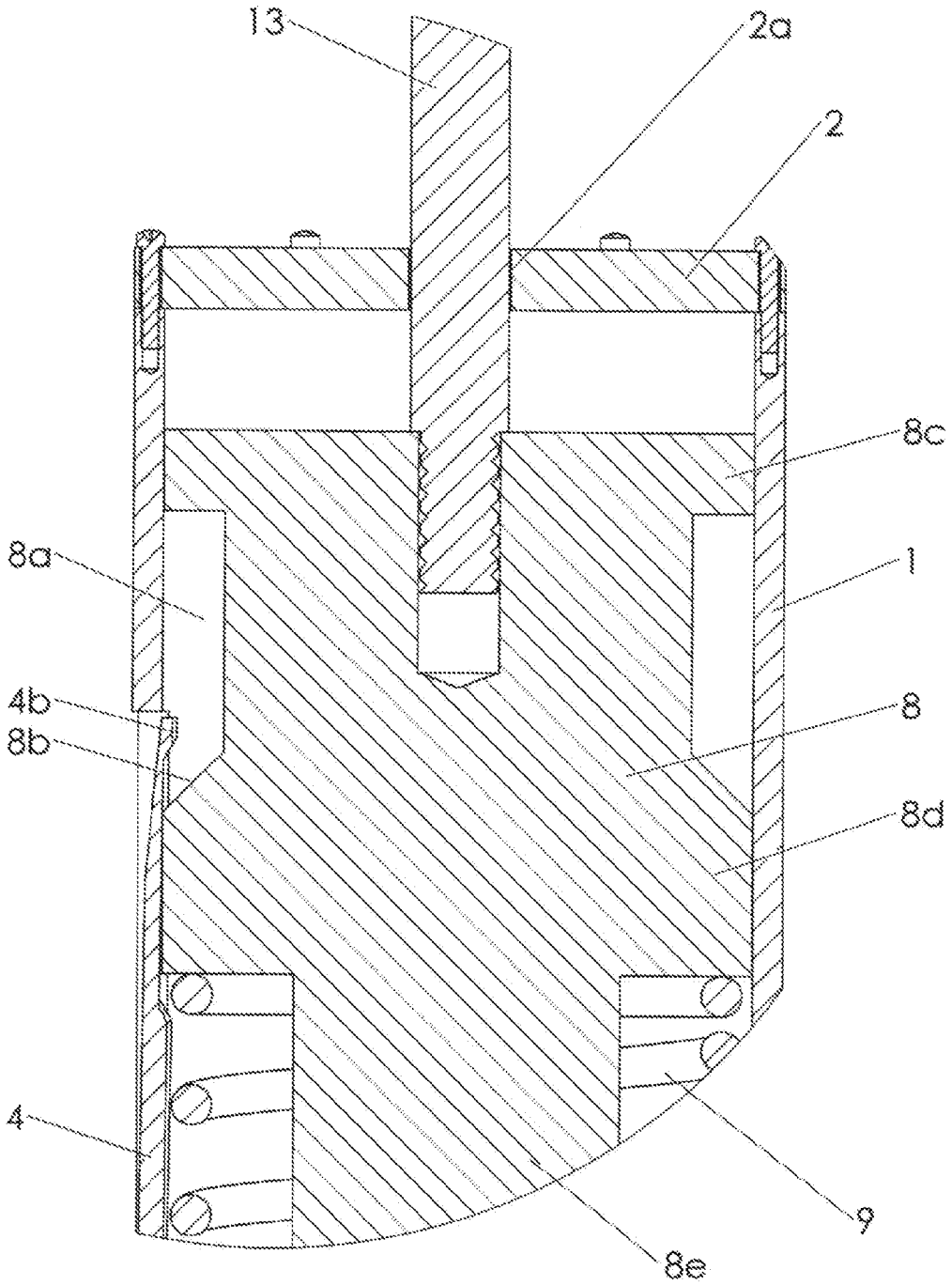
FIG. 11 is a detail section view of the upper end of the lever shown with the present invention in an unlocked state.
Figure 12:
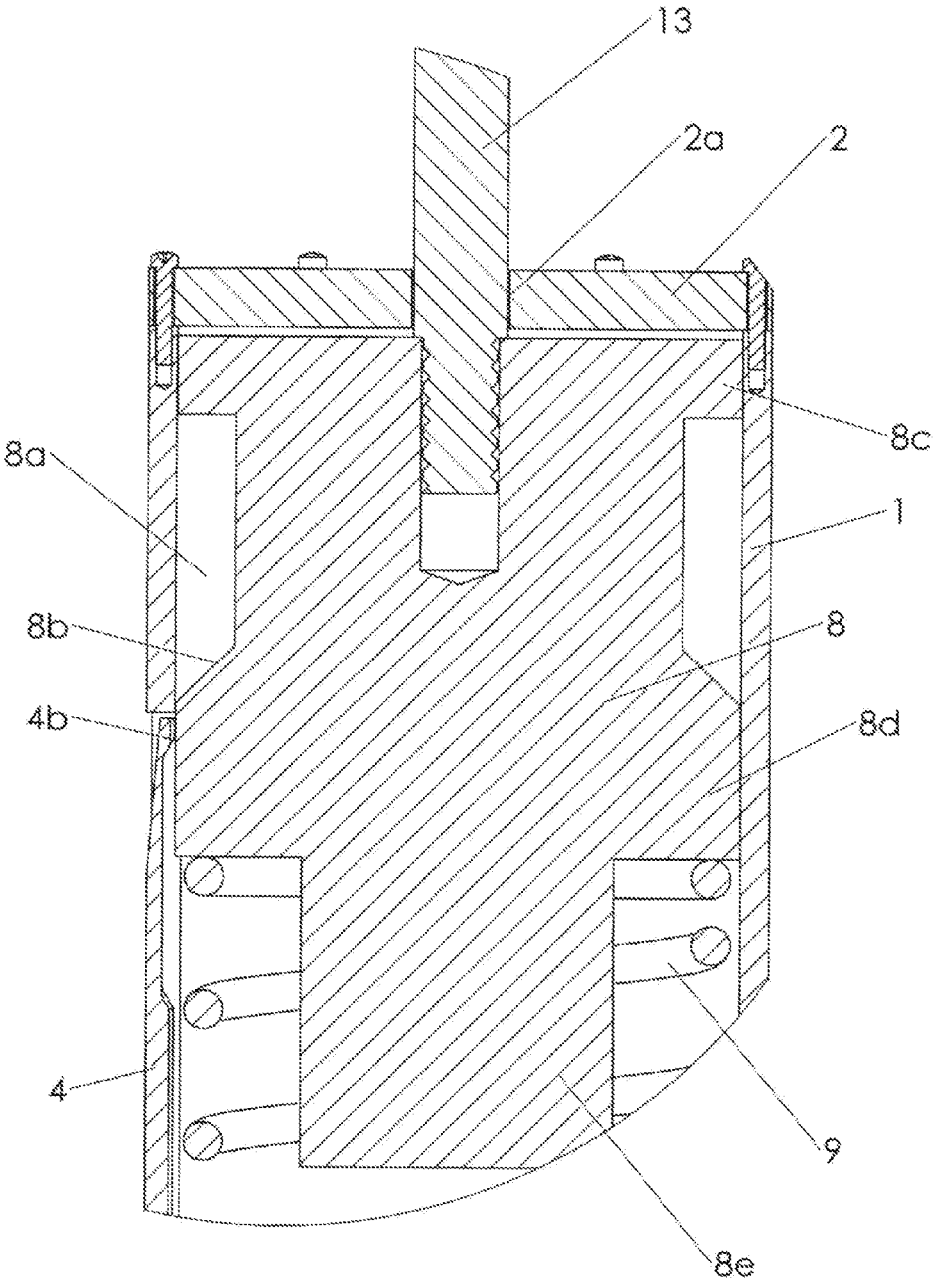
FIG. 12 is a detail section view of the upper end of the lever shown with the present invention in a locked state.

FIG. 11 is a detail section view of the upper end of the lever shown with the present invention in an unlocked state. FIG. 12 is a detail section view of the upper end of the lever shown with the present invention in a locked state. Referring to FIG. 11, note that the top end 4*b* of the lever 4 has moved into a recess 8*a* in the outer wall of the plunger 8 as a result of the plunger 8 being forced downward. When the top end 4*b* of the lever 4 moves into this recess 8*a*, the lever 4 pivots on its shaft 4*a* (see FIG. 13). The lever is constructed (in terms of length, material and curvature) so that it functions like a spring in that the top end 4*b* of the lever 4 automatically snaps into the recess 8*a* as soon as the recess 8*a* aligns laterally with the top end 4*b* of the lever 4. When the plunger 8 is pulled upward, the top end 4*b* of the lever 4 slides along the floor 8*b* of the recess 8*a* until it is situated against the outer wall of the plunger 8 once again, as shown in FIG. 12. Note that the floor 8*b* of the recess 8*a* is preferably slanted diagonally downward so as not to snap off the top end 4*b* of the lever 4.

Figure 13:
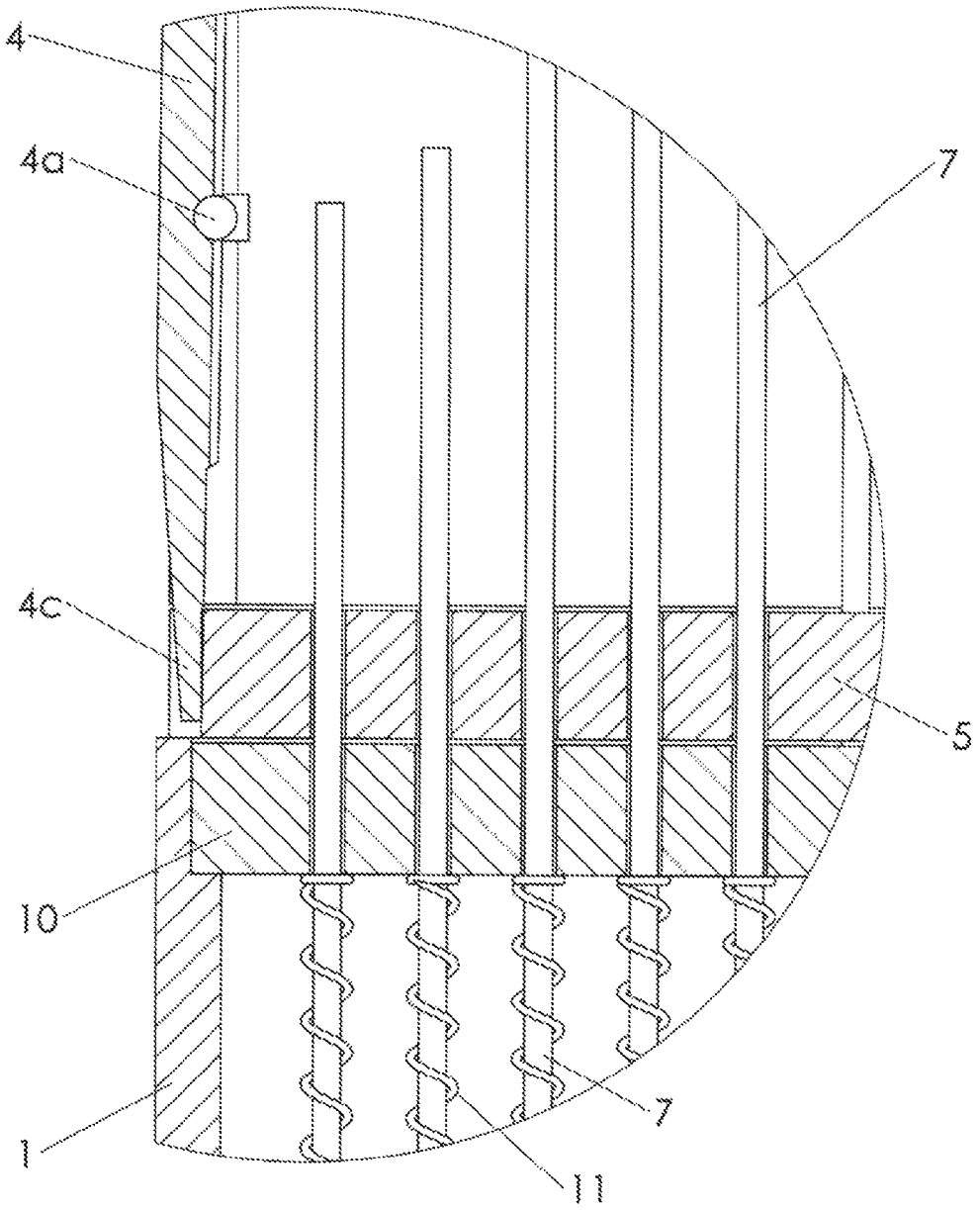
FIG. 13 is a detail section view of the bottom end of the lever shown with the present invention in an unlocked state.
Figure 14:
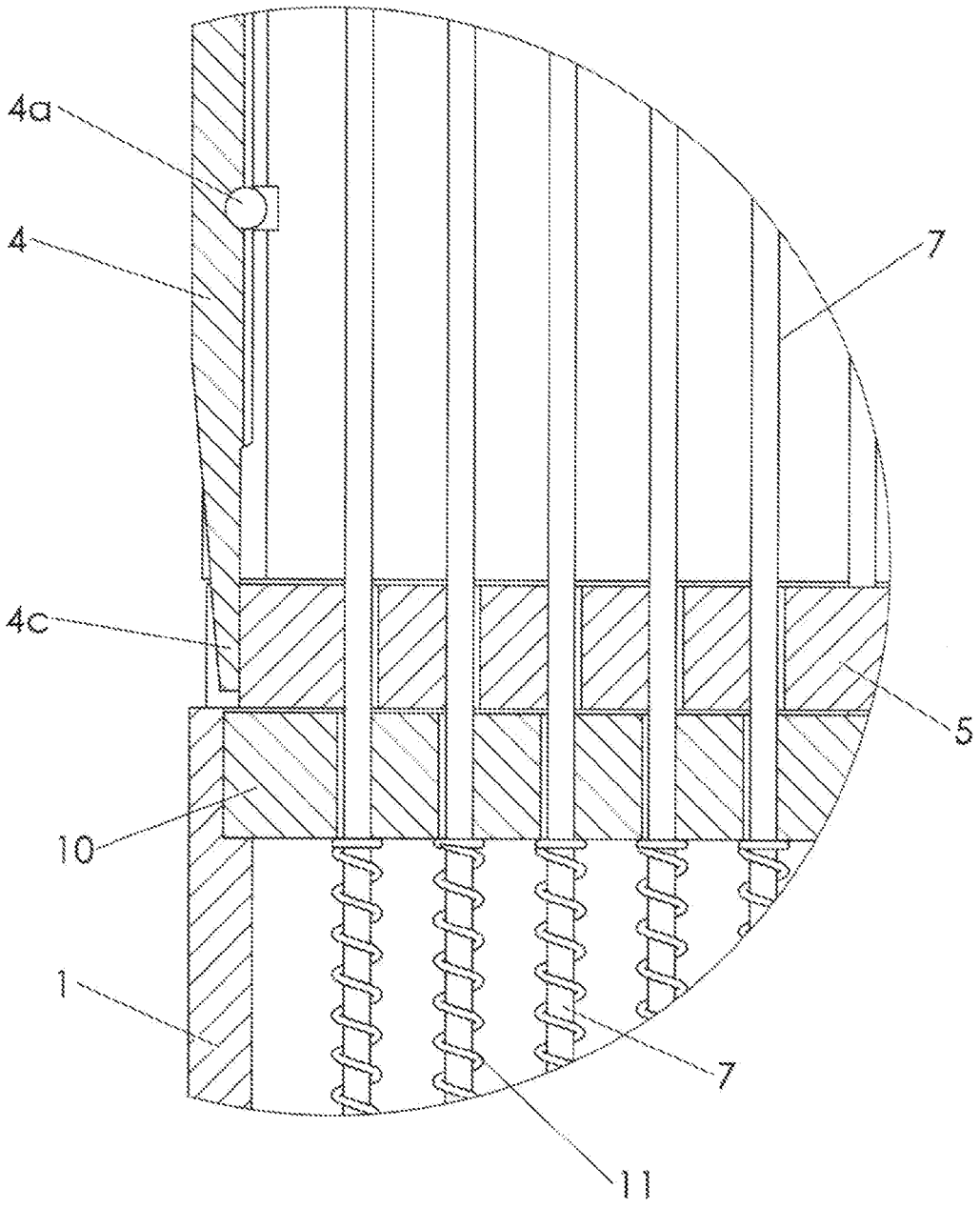
FIG. 14 is a detail section view of the bottom end of the lever shown with the present invention in a locked state.

FIG. 13 is a detail section view of the bottom end of the lever shown with the present invention in an unlocked state. FIG. 14 is a detail section view of the bottom end of the lever shown with the present invention in a locked state. Referring to FIG. 13, when the top end 4*b* of the lever 4 snaps into the recess 8*a* in the plunger 8 (see FIG. 11), the lever 4 pivots so that the bottom end 4*c* of the lever 4 moves laterally outward (away from the center of the tool), thereby releasing the pressure on the pressure lock plate 5 and allowing the holes in the pressure lock plate 5 and pressure base 10 to re-align with one another (see FIG. 15). When the plunger 8 is moved upward by the decompression of the main spring 9 and the top end 4*b* of the lever 4 is forced back outward (see FIG. 10), the lever 4 pivots so that the bottom end 4*c* of the lever 4 moves laterally inward (toward the center of the tool), thereby moving the pressure lock plate 5 laterally so that the holes in the pressure lock plate 5 do not align with the holes in the pressure base 10 (see FIG. 16) and the elongated rods 7 are squeezed such that the pressure renders them immobile. Note that the bottom end 4*c* of the lever 4 terminates at a point directly adjacent to the outside surface of the pressure lock plate 5 but above the top surface of the pressure base 10. Preferably, the bottom end 4*c* of the lever 4 is almost as long as the entire thickness of the pressure lock plate 5 so as to gain enough leverage to push the pressure lock plate laterally.

Figure 15:
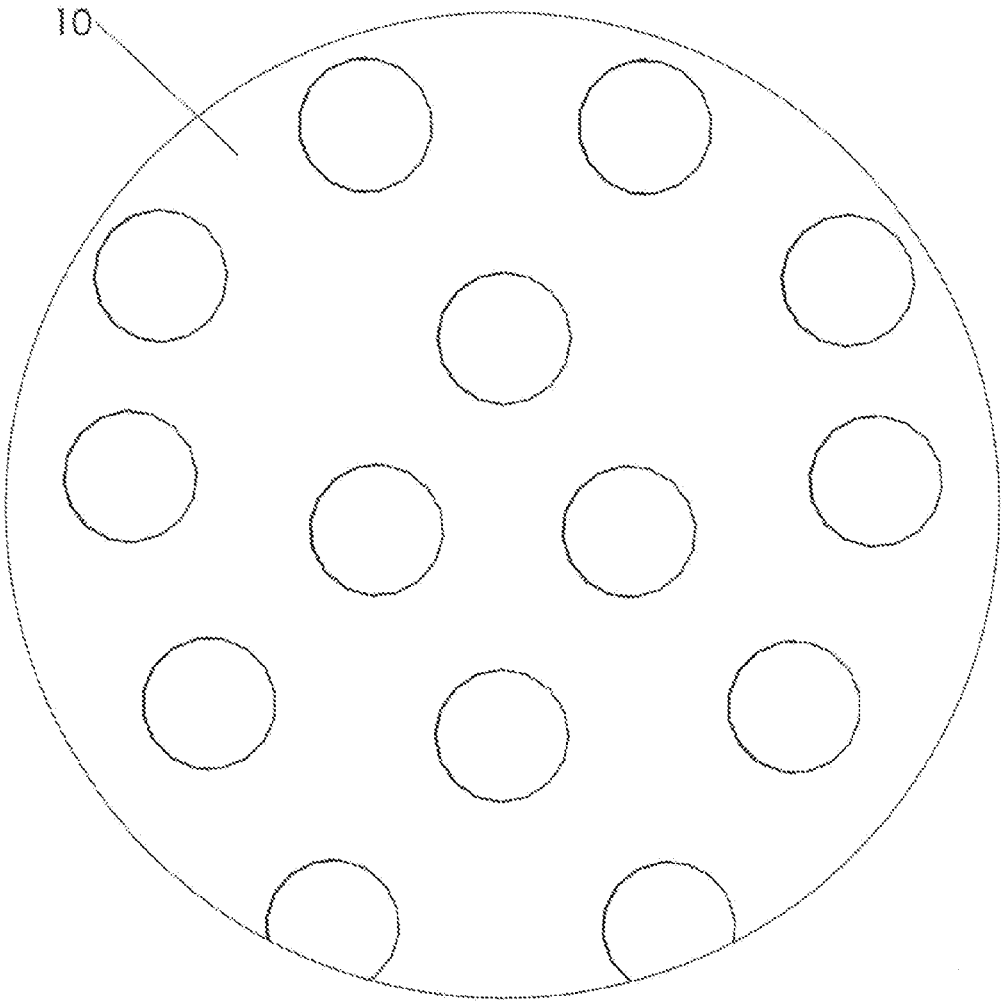
FIG. 15 is a bottom view of the pressure base and pressure lock plate showing the alignment of these two components when the present invention is in an unlocked state.

FIG. 15 is a bottom view of the pressure base and pressure lock plate showing the alignment of these two components when the present invention is in an unlocked state. FIG. 16 is a bottom view of the pressure base and pressure lock plate showing the alignment of these two components when the present invention is in a locked state. The pressure lock plate 5 is not actually visible in FIG. 15 because the holes in the pressure base 10 and pressure lock plate 5 are directly aligned. The degree of movement of the pressure lock plate 5 as compared to the pressure base 10 has been exaggerated in these drawings to illustrate the relation between the two plates; however, in a preferred embodiment, the pressure lock plate 5 actually moves less than 1/16 inch.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A tool for creating impressions of downhole objects comprising:

(a) a cylindrical outer casing;

(b) a top plate that is situated inside of the outer casing at a top end of the tool;

(c) a plunger that is situated directly underneath the top plate;

(d) an end plate that is situated inside of the outer casing at a bottom end of the tool;

(e) a lever with a top end and a bottom end, the lever being situated within a longitudinal slot in the outer casing;

(f) a pressure lock plate;

(g) a pressure base that is situated beneath the pressure lock plate;

(h) a main spring platform that is situated beneath the plunger, the pressure lock plate being situated beneath and spaced apart from the main spring platform;

(i) a main spring that is situated between the plunger and the main spring platform; and (j) a plurality of elongated rods that are not attached to the main spring platform but extend from beneath the main spring platform through a plurality of holes in the pressure lock plate, through a plurality of holes in the pressure base, and through a plurality of holes in the end plate, wherein each of the plurality of elongated rods is surrounded by a rod spring and a collar that is situated below the rod spring, and wherein the rod spring on each of the plurality of elongated rods extends from a bottom of the pressure base to the collar;

wherein the pressure lock plate moves laterally when the lever pivots from a locked position to an unlocked position, thereby aligning the plurality of holes in the pressure lock plate with the plurality of holes in the pressure base and enabling the elongated rods to move longitudinally within the tool and make contact with the downhole object to form the impression.

2. The tool of claim 1, wherein the outer casing comprises a first lateral slot through which at least a portion of the pressure lock plate extends and a second lateral slot through which at least a portion of the main spring platform extends.

3. The tool of claim 2, wherein the portion of the pressure lock plate that extends through the first lateral slot and the portion of the main spring platform that extends through the second lateral slot are flush with an outer surface of the outer casing.

4. The tool of claim 1, wherein the plunger comprises a recess with a floor, the recess being situated between a top section of the plunger and a midsection of the plunger, wherein the top section and the midsection each has an outer diameter, wherein the outer diameter of the top section is approximately equal to the outer diameter of the midsection, wherein the plunger further comprises a bottom section with an outer diameter that is less than the outer diameters of the top section and midsections, and wherein the bottom section extends through a center of the main spring.

5. The tool of claim 4, wherein the top end of the lever is situated against an outer wall of the plunger when the tool is in the locked position, wherein when the plunger is pushed downward, the top end of the lever moves into the recess in the outer wall of the plunger, and the lever pivots on a shaft that resides in a recess set into the outer casing, and wherein when the plunger is moved upward, the top end of the lever slides along the floor of the recess until it is situated against the outer wall of the plunger.

6. The tool of claim 5, wherein the floor of the recess is slanted diagonally downward.

7. The tool of claim 5, wherein when the top end of the lever moves into the recess in the plunger, the lever pivots so that the bottom end of the lever moves laterally outward, thereby causing the plurality of holes in the pressure lock plate to realign with the plurality of holes in the pressure base.

8. The tool of claim 5, wherein when the plunger is moved upward and the top end of the lever slides along the floor of the recess until it is situated against the outer wall of the plunger, the lever pivots so that the bottom end of the lever moves laterally inward, thereby moving the pressure lock plate laterally so that the plurality of holes in the pressure lock plate do not align with the plurality of holes in the pressure base and the elongated rods are squeezed.

9. The tool of claim 5, wherein the bottom end of the lever terminates at a point directly adjacent to an outside surface of the pressure lock plate above a top surface of the pressure base.

10. The tool of claim 5, wherein the pressure lock plate has a thickness, and wherein the bottom end of the lever is approximately as long as the thickness of the pressure lock plate.

* * * * *